US012083403B2

(12) United States Patent
Palmgren

(10) Patent No.: US 12,083,403 B2
(45) Date of Patent: Sep. 10, 2024

(54) GOLF CLUB SWING ARC IMPACT LOCATION TRAINING SYSTEM

(71) Applicant: Thomas Palmgren, Cape May Court House, NJ (US)

(72) Inventor: Thomas Palmgren, Cape May Court House, NJ (US)

( * ) Notice: Subject to any disclaimer, the term of this patent is extended or adjusted under 35 U.S.C. 154(b) by 198 days.

(21) Appl. No.: 17/813,096

(22) Filed: Jul. 18, 2022

(65) Prior Publication Data

US 2024/0017148 A1 Jan. 18, 2024

(51) Int. Cl.

*A63B 69/36* (2006.01)
*A63B 69/00* (2006.01)
*A63B 71/06* (2006.01)

(52) U.S. Cl.

CPC ..... *A63B 69/362* (2020.08); *A63B 69/0091* (2013.01); *A63B 69/3661* (2013.01); *A63B 71/0622* (2013.01); *A63B 2071/0694* (2013.01); *A63B 2209/08* (2013.01); *A63B 2214/00* (2020.08); *A63B 2220/05* (2013.01); *A63B 2220/805* (2013.01); *A63B 2220/807* (2013.01); *A63B 2220/833* (2013.01)

(58) Field of Classification Search

CPC ..... A63B 69/362; A63B 69/0091; A63B 69/3661; A63B 71/0622; A63B 2071/0694; A63B 2209/08; A63B 2214/00; A63B 2220/05; A63B 2220/805; A63B 2220/807; A63B 2220/833; A63B 69/3623; G06T 7/00

USPC ..... 473/215, 278, 279, 409, 139, 141, 151, 473/218, 257, 262

See application file for complete search history.

(56) References Cited

U.S. PATENT DOCUMENTS

| | | | | | |
|---|---|---|---|---|---|
| 3,345,073 | A * | 10/1967 | Hoffman | A63B 69/0091 | 473/139 |
| 3,743,296 | A * | 7/1973 | Branz | A63B 69/0091 | 473/140 |
| 3,870,314 | A * | 3/1975 | Bertucci | A63B 69/0091 | 473/141 |
| 5,273,285 | A * | 12/1993 | Long | A63B 69/3661 | 473/278 |
| 5,593,355 | A * | 1/1997 | Beaver | A63B 69/3661 | 473/262 |
| 7,104,900 | B1 * | 9/2006 | Finley | A63B 69/3661 | 273/108 |
| 7,549,932 | B1 * | 6/2009 | Miyamoto | A63B 69/3661 | 473/278 |
| 7,691,003 | B2 * | 4/2010 | Munshi | A63B 69/0091 | 473/409 |
| 9,468,831 | B2 * | 10/2016 | Brantingham | A63B 69/3655 | |
| 10,058,759 | B1 * | 8/2018 | Saint-Louis | A63B 71/0622 | |

(Continued)

*Primary Examiner* — Nini F Legesse

(74) *Attorney, Agent, or Firm* — Savantek Patent Services; Ivan E. Rozek

(57) ABSTRACT

A golf club swing arc impact location training system that helps the user to determine the ideal deepest point of his or her swing in relation to the location of the ball being hit. A rigid rectangular frame is topped by an elastic panel that can be deformed when the user swings and hits a golf ball attached to a tether assembly fixed to the edge of the rectangular frame. An array of photodiodes mounted on the inner surface of the frame senses the location of the depressed elastic panel as the ball is hit and sends the results to a digital display mounted on the top surface of the frame.

5 Claims, 9 Drawing Sheets

(56) References Cited

U.S. PATENT DOCUMENTS

| | | | | |
|---|---|---|---|---|
| 11,219,813 | B2 * | 1/2022 | Shin | A63B 71/0622 |
| 2004/0137999 | A1 * | 7/2004 | Park | A63B 69/3623 473/278 |
| 2008/0032811 | A1 * | 2/2008 | Bearden | A63B 69/3661 473/278 |

* cited by examiner

GOLF CLUB SWING ARC IMPACT LOCATION TRAINING SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of golf training tools and dispensing devices and more specifically to a golf club arc impact training system essentially comprising a cuboid golfer stand and a cuboid golfer swing practice assembly that includes sensors to detect and display the impact location of the user's golf club in relation to the arc of the swing.

BRIEF SUMMARY OF THE INSTANT INVENTION

Golfers routinely spend much time and money with golf coaches and training equipment on perfecting an ideal swing but are generally not trained to cause the deepest point of the swing to be in the correct location in relation to the ball.

Inventor's professional experience shows that the optimal swing causes a divot approximately one inch in front of where the ball was originally resting. This is counter intuitive to most golfers who think that the divot should be just behind where the ball was originally resting. By using the arc impact training system of the instant invention, a golfer can train himself or herself to cause the divot to be in the ideal club head to ball location for maximum power and distance.

The primary object of the invention is to provide a golf club swing arc ball impact training system for a golfer to practice hitting a golf ball at the bottom location of the swing, which results in hitting the ball to go further and straighter than when not struck at the ideal location; to provide a training system that includes a tethered ball and an elastic panel representing a golf course surface, which can be deformed as the user's club head drives toward the ball. The location and shape of the elastic panel deformation can be sensed by photosensors such as photodiodes located to the side of and under the elastic panel. A graphic display built onto the surface of the practice assembly indicates if the location of the bottom, that is of the deepest point of the swing arc, is ideal or not. Golfers routinely spend much time and money with golf coaches and training equipment on perfecting an ideal swing but are generally not trained to cause the deepest point of the swing to be in the correct location in relation to the ball.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a golf training system that includes a golfer swing practice assembly comprising a rigid rectangular frame, with an elastic panel attached to the top of the frame, the elastic panel representing a golf course surface. A horizontally tethered golf ball is attached to the top surface of the practice assembly frame so that the ball is located centrally and slightly above, i.e. essentially resting on, the elastic panel. A plurality of sensors located in the hollow space below and to the side of the elastic panel sense the deepest point of the arc of the golfer's swing based on the deformation, i.e. vertical deflection, of the elastic panel as the golfer swings to hit the ball. The resulting information regarding deepest point location is then instantly displayed on a display located on the top surface of the rigid frame. The training system also includes a golfer stand having a mat representing a golf course surface, the mat elevation matching that of the practice assembly elastic panel

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
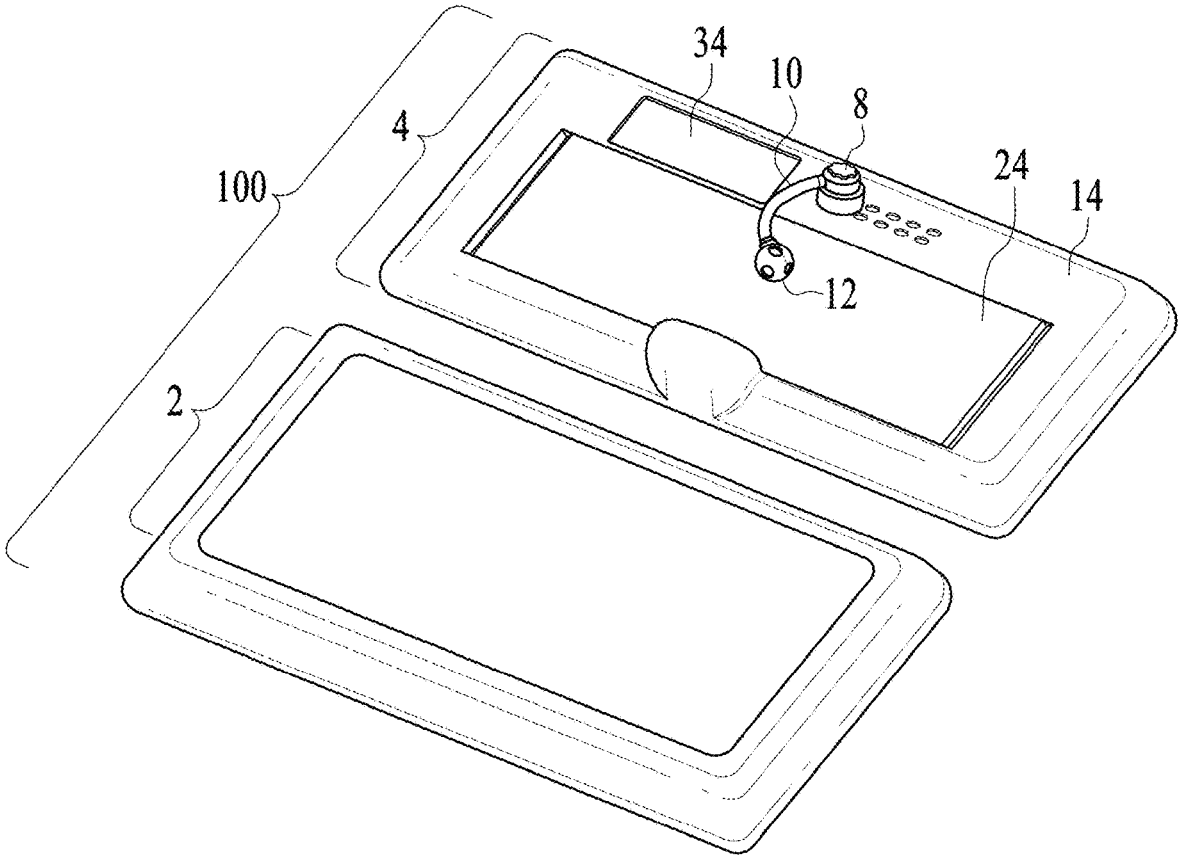
FIG. 1 is a perspective view of the embodiment.

Referring now to FIG. 1 we see a perspective view of the embodiment 100. A user stands on a golfer stand 2 having a mat golf course simulating top surface, which is elevated to be level with the top surface of practice assembly 4. A devices holding frame member of the practice assembly includes electronic sensing and display devices to determine the deepest point of the user's swing. A golf ball 12 is tethered by arm 10 to a rotating tether assembly 8 so that the ball 12 resides in the central portion of the elastic panel 24 located a small distance below it, thus the ball 12 essentially rests on the elastic panel 24. A rigid frame 14 holds the elastic panel 24 taught like a drum. The user's swing data acquisition and processing components of the instant embodiment include a display 34 to show the user how well he or she matched the ideal deepest point location of the club swing, which is slightly in front of the ball when hitting on a fairway and slightly behind the ball when hitting out of a sand trap. Additional swing data acquisition and processing components of the instant embodiment are shown in FIGS. 2 through 9.

Figure 2:
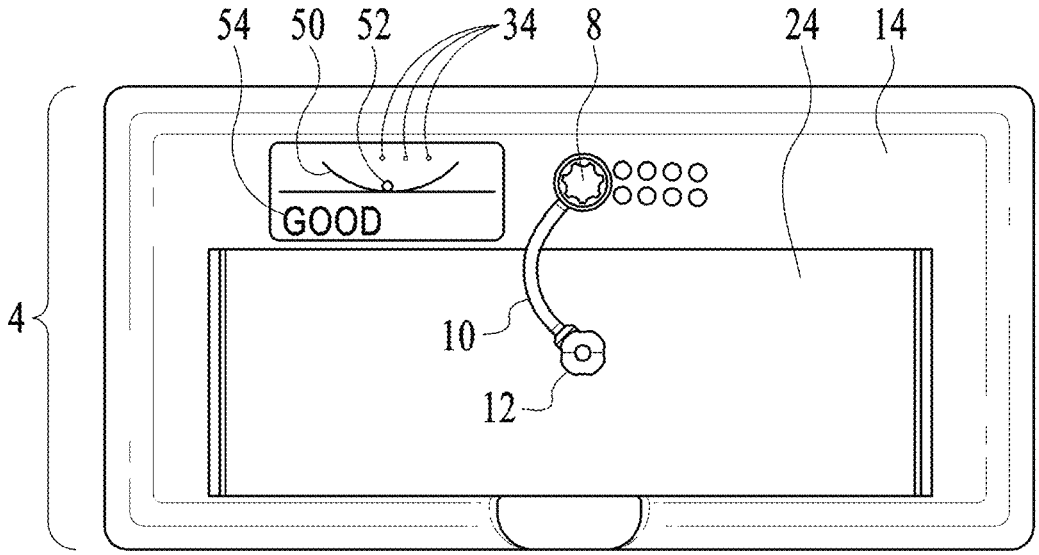
FIG. 2 is a top plan view of the practice assembly.

FIG. 2 is a top plan view of the electronic practice assembly 4. Ball 12 is located in the center of elastic panel 24, that is the ball resting position. The ball automatically ends up in the central position by use of magnets in the rotating tether assembly 8. Display 34 shows the arc 50 of the user's swing in relation to the ball 52. The result of sensing the location of the deepest point of the swing of the elastic panel based on the deflection of the elastic panel is displayed as a graphic symbol or a word such as "good" 54.

Figure 3:
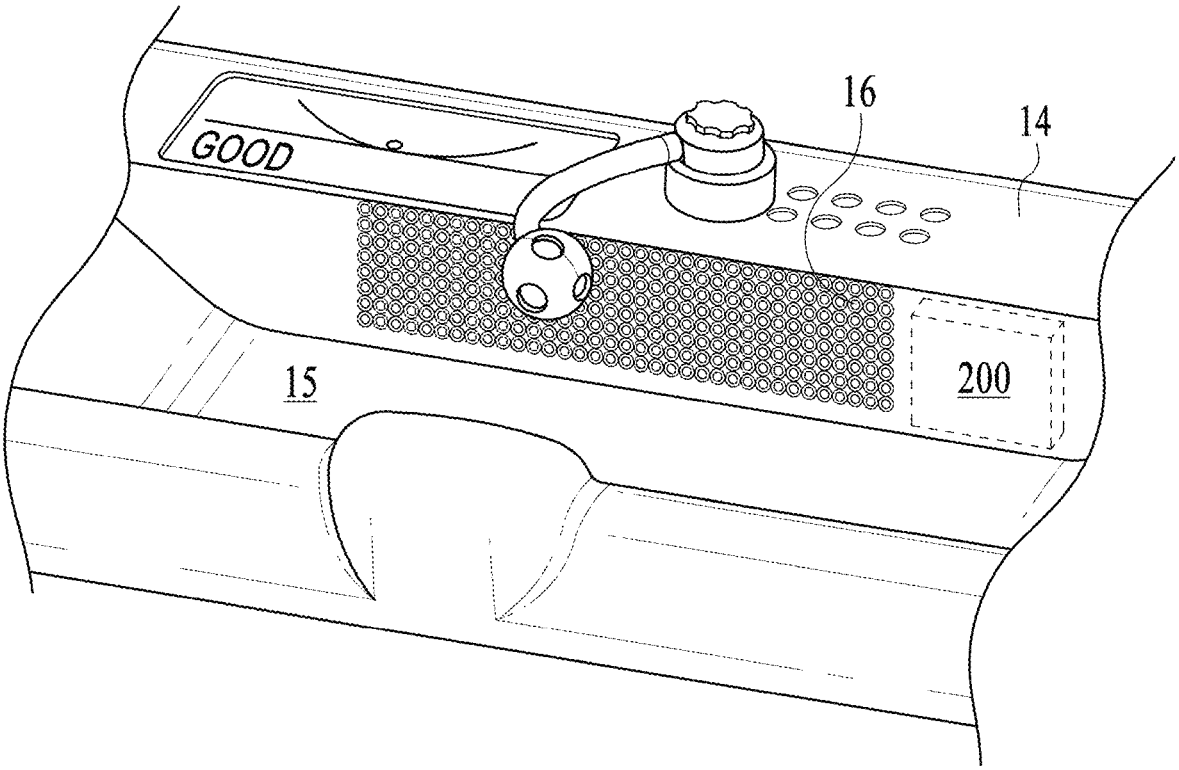
FIG. 3 is a partial perspective view of the practice assembly with the elastic panel removed.

FIG. 3 is a partial perspective view of the practice assembly 4 with the elastic top panel removed showing a hollow portion 15 formed by the sides of the rectangular rigid frame 14. A plurality of photosensors, such as photodiodes, 16, is positioned to monitor the deflection of the elastic panel 24 as the club head presses down on the elastic panel 24 during the swing. The pressing down of the elastic panel 24 equates to a "divot" that is formed on the golf green when playing under standard conditions. Ideally, the deepest point of the divot should be approximately one inch in front of the ball during the arc of the swing. The front of the ball is defined as the area located in the space between the ball and the forward direction of the flight of the ball. This location of the deepest point of the swing aids in hitting the ball further and straighter than when not struck at the ideal location. Golfers routinely spend much time and money with golf coaches and training equipment on perfecting an ideal swing but are generally not trained to cause the deepest point of the swing to be in the correct location in relation to the ball.

Figure 4:
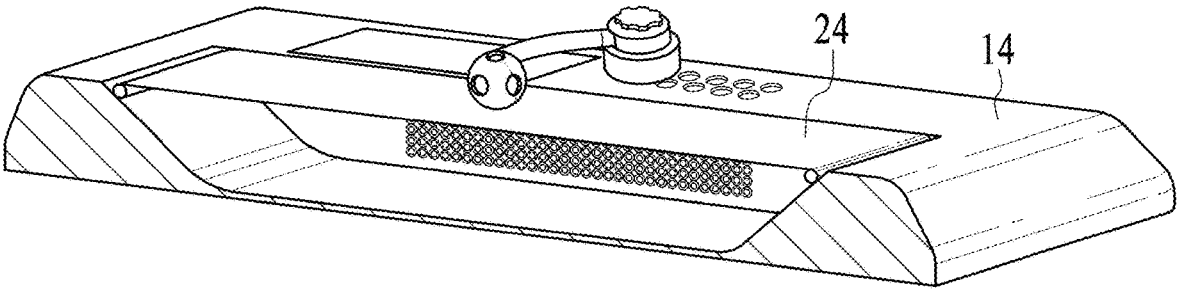
FIG. 4 is a perspective section view of the practice assembly.

FIG. 4 is a side section view of the electronic practice assembly showing the elastic panel 24 in the flat position.

Figure 5:
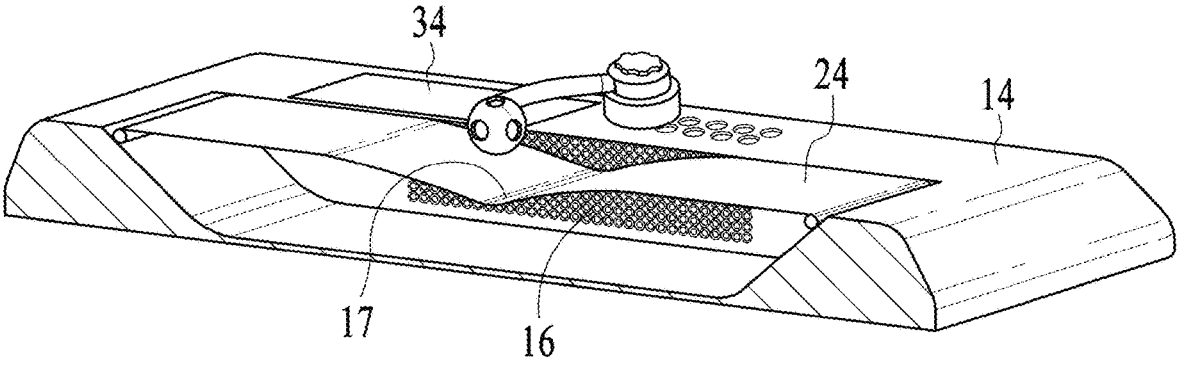
FIG. 5 is a perspective section view of the practice assembly with the elastic panel being deformed.

FIG. 5 is a side section view of the electronic practice assembly showing the elastic panel 24 in a deformed position as the club head bears down on the elastic panel 24 during a golf swing. The plurality of photosensors 16 sense the deformation 17. A data acquisition and data processing unit 200 may be composed of various standard electronic components, such as data acquisition electronic hardware, a microprocessor or a microcontroller, and battery power supply, located within the hollow portion of the rigid frame 14 converts the outputs of the photodiodes 16 into graphic representation of the elastic panel mat deformation and sends corresponding data to display 34.

Figure 6:
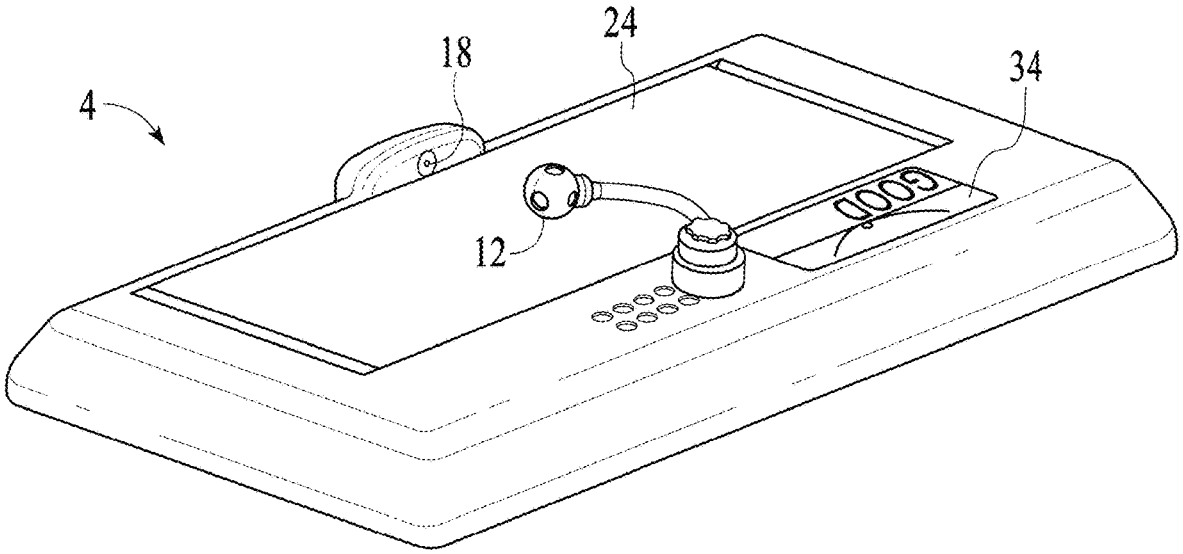
FIG. 6 is a perspective view of the practice assembly showing the club capture camera.

FIG. 6 is a side view perspective of the electronic practice assembly 4 showing the golf club swing arc recording camera 18 located in the frame member parallel with the devices holding member with respect to the tethered ball 12 shown in rest over the elastic panel 24.

Figure 7:
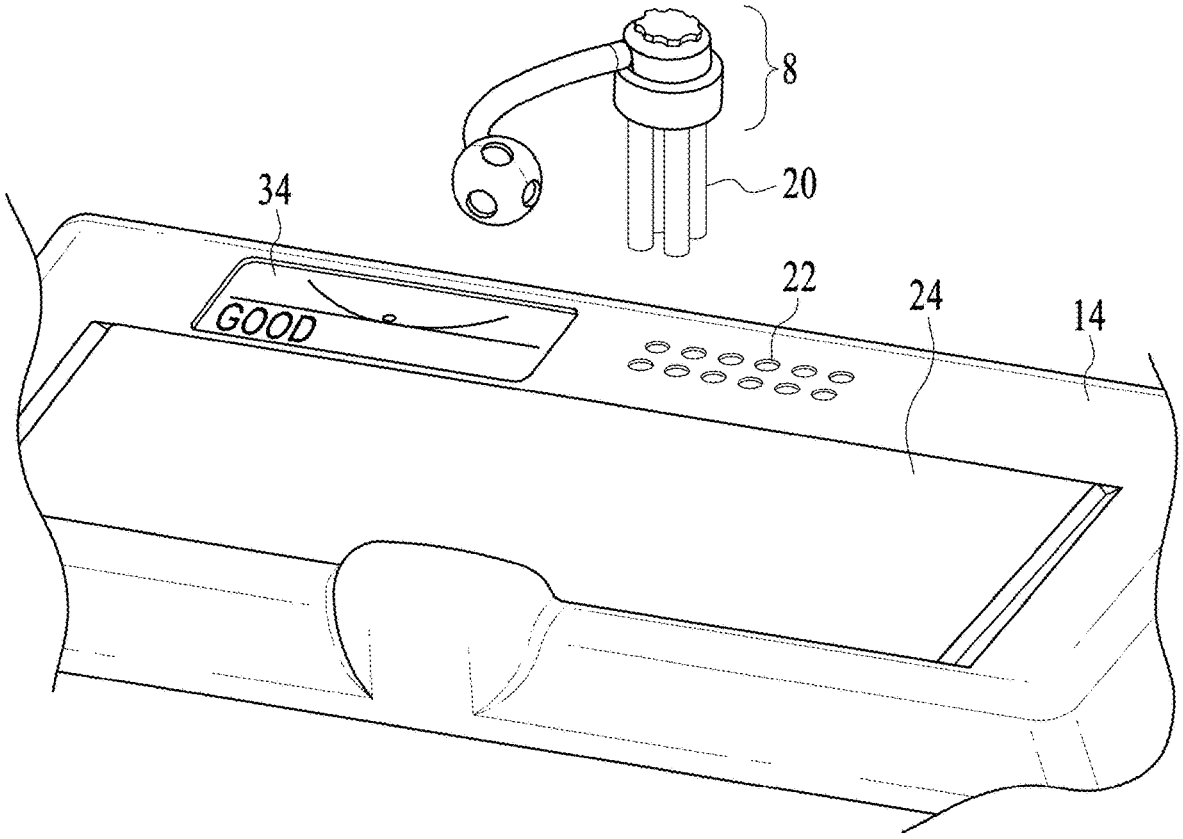
FIG. 7 is an exploded view of the ball rotating header assembly about to be inserted into the frame of the golf practice assembly.

FIG. 7 is a partial perspective view of the electronic practice assembly with the rotating tether assembly 8 removed from sockets 22. The anchor pins 20 of the rotating assembly can be inserted into the left side of the sockets 22, or the middle or the right side of the sockets 22. This allows the user to practice fairway ball hitting in which the deepest point of the swing should be in front of the ball, or a sand trap condition where the deepest point of the swing should be slightly behind the ball.

Figure 8:
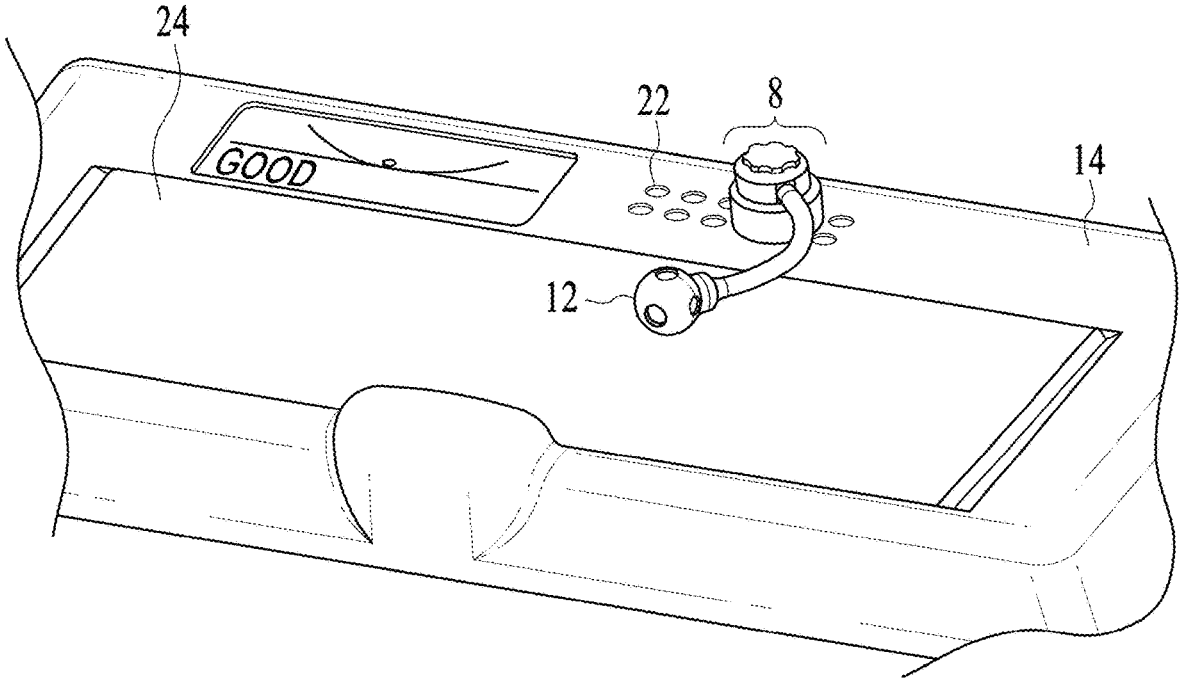
FIG. 8 is a perspective view showing the golf ball rotating header assembly inserted into sockets on the frame.

FIG. 8 is a partial perspective view of the electronic practice assembly where the rotating tether assembly 8 is located so that the ball is behind the deepest point of the swing if the direction of the ball is moving toward the left of the ball 12.

Figure 9:
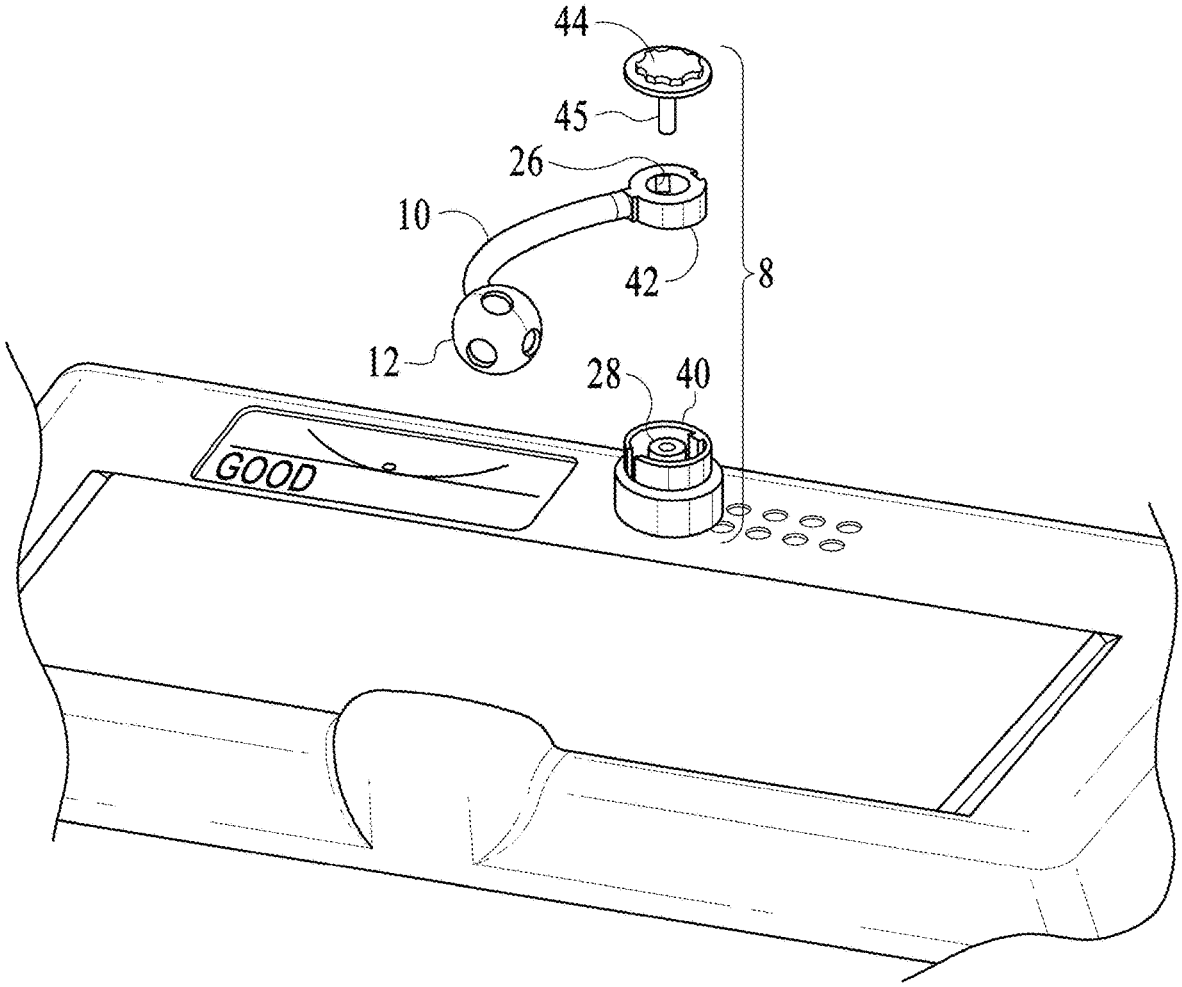
FIG. 9 is an exploded view of the golf ball rotating header assembly.

FIG. 9 is an exploded view of the rotating tether assembly 8. Cap 44 includes a downward facing screw 45 that penetrates an aperture in the tether rotor 42 center. The tether rotor 42 is inserted into stator 40 and rotatably held in place by screw 45. A magnet 26 located on the side of tether rotor 42 is drawn to a magnet 28 located in the side wall of stator 40 causing the ball 8 to stop at the central location over the elastic panel 24 after it stops rotating after the ball has been hit. Alternately, rotor 42 and stator 40 can be a rotor and a stator respectively of a stepper motor; the shaft of a stepper motor can function as the axle about which the tether rotor 42 is attached. The stepper motor can sense the location of the tether arm 10 and the data processing unit can cause the stepper motor to brake when the tether arm 10 is in the correct position to land the ball 8 at the resting position on the elastic panel 24.

Figure 10:
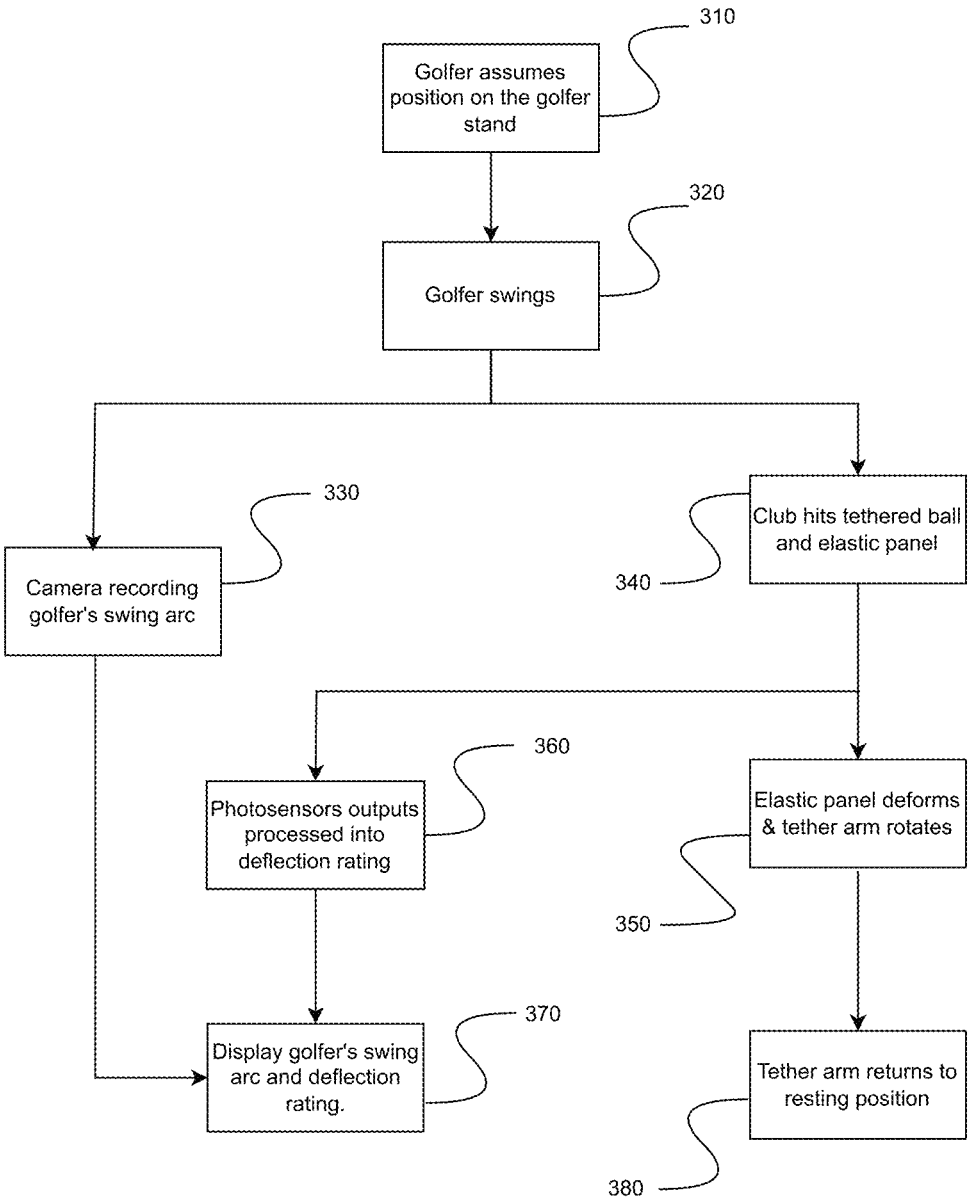
FIG. 10 is a flow chart of using the golf club swing arc impact location training system.

FIG. 10 is the flow chart of using the swing arc impact location training system for training. The process steps are: 310, the golfer assumes a golf club swing position on the elastic flexible panel; 320, the golfer swings the club arc; 330, camera records the swing, the swing club arc is displayed in 370; 340, the club hits the tethered ball; 350 the elastic panel deforms and the tether arm rotates in reaction to the club hit; 360, the photosensors outputs affected by the elastic panel deformation and are processed into deflection rating displayed in 370. Steps 340, 350, and 360 are happening simultaneously with step 330.

It is to be understood that the sensing and display devices of the golf club swing arc can be also implemented by other electronic devices.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Definitions

In the claims, the word 'comprising' does not exclude the presence of other elements or steps than those listed in a claim. Furthermore, the terms "a" or "an," as used herein, are defined as "one, or more than one." Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are arbitrarily used to distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

In the claims, the word 'up', unless described otherwise, has its ordinary meaning of upward from the ground or surface; conversely, the word 'down', unless described otherwise, has its ordinary meaning of toward or to the ground, floor, or bottom.

In the claims, the expressions 'deepest point' and 'bottom', unless described otherwise, have its ordinary meaning of the deepest point of the golf club swing, typically the location of the club hitting the golf course surface.

Term "deformation" as used in the specification and in the claims has its ordinary meaning of change of shape. Term "deflection" is equivalent to "deflection" as used in structural engineering, that is the degree to which an element (such as a beam) is deformed laterally.

In the claims, the word 'top', unless described otherwise, has its ordinary meaning of being the highest, i.e., vertically furthest from the ground, floor, or bottom.

What is claimed is:

1. A golf club swing arc impact location training system comprising:

an essentially cuboid golfer stand assembly for a golfer to stand on while using the golf club swing arc impact location training system, the essentially cuboid golfer stand assembly comprising:

a golfer stand frame;

a mat simulating a golf course surface disposed on the golfer stand frame;

an essentially cuboid practice assembly comprising:

a rigid frame enclosing a hollow space, the rigid frame comprising:

two parallel short side members, the two parallel short side members each having an equipment end and a camera end;

a devices holding long side member perpendicularly joining the two parallel short side frame members at the equipment ends;

a camera holding long side member perpendicularly joining the two parallel short side members at the camera ends;

an elastic panel having a shape held taught between the two parallel short side members covering the enclosed hollow space wherein the shape is flat when not deflected;

a camera disposed in the camera holding long side member facing the devices holding long side frame member;

a relocatable rotating ball tether assembly disposed on the devices holding long side frame member;

a plurality of electronic photosensors having output signals affected by a deformation of the elastic panel shape;

a plurality of electronic data processing components for acquiring the signals from the plurality of the electronic photo sensors, and processing the acquired signals into a displayable data;

a plurality of sockets disposed in two rows along the devices holding long side frame member; and a display for displaying the displayable data.

2. The golf club swing arc impact location training system of claim 1, wherein the elastic panel deforms when a force is exerted by a golf club on the elastic panel, wherein furthermore the elastic panel member becomes flat whence there is no force exerted upon the elastic panel.

3. The golf club swing arc impact location training system of claim 1, wherein the relocatable rotating ball tether assembly comprises:

a stator and a rotor;

at least one magnet disposed in the stator;

at least one magnet disposed in the rotor;

a tether arm attached to the rotor;

a ball attached to the tether arm, wherein the ball is resting on the elastic flat mat panel in front of the camera when there is no other force exerted on the tether arm;

the stator magnets acting on the rotor magnets causing the rotor to return the location defined by the magnets when there is no other force exerted on the rotor; and a plurality of anchor pins, wherein the plurality of anchor pins is insertable into the plurality of sockets disposed on the devices holding long side frame member whereby enabling the relocatable rotating ball tether assembly to be located closer or farther from either one of the two parallel short side frame members.

4. The golf club swing arc impact location training system of claim 1, wherein the relocatable rotating ball tether assembly comprises:

a stepper motor, the stepper motor comprising a stepper motor stator and a stepper motor rotor;

a tether arm attached to the stepper motor rotor;

a ball attached to the tether arm, wherein the ball is resting on the elastic flat mat panel;

the stepper motor rotor having a nonactive position;

the stepper motor causing the stepper motor rotor to return the nonactive position when there is no other force exerted on the stepper motor rotor; and a plurality of anchor pins, wherein the plurality of anchor pins is insertable into the plurality of sockets disposed on the devices holding long side frame member whereby enabling the relocatable rotating ball tether assembly to be located closer or farther from either one of the two short frame members.

5. A method of training a golfer to practice hitting a golf ball at a bottom location of a swing comprising:

providing a golf club swing arc impact location training system comprising:

a golfer stand assembly for the golfer to stand on while using the golf club swing arc impact location training system;

a practice assembly comprising:

a rigid frame enclosing a hollow space, the rigid frame comprising:

two parallel short side members, the two parallel short side members each having an equipment end and a camera end;

a devices holding long side member perpendicularly joining the two parallel short side frame members at the equipment ends;

a camera holding long side member perpendicularly joining the two parallel short side members at the camera ends;

an elastic panel having a shape held taught covering the enclosed essentially hollow space, wherein the elastic panel shape is flat when not deformed by an external force;

a camera disposed in the camera holding long side member facing the devices holding long side frame member;

a relocatable rotating ball tether assembly disposed on the devices holding long side frame member wherein a ball, the ball disposed on a tether arm attached to a tether rotor disposed on the rotating ball tether assembly having, the tether arm and the ball being in a resting position with the ball on the elastic panel;

the relocatable rotating ball tether assembly causing the tether arm and the ball to return to the resting position after being dislocated;

a plurality of electronic photo sensors that have output signals affected by the elastic panel shape;

a plurality of electronic data acquisition and processing components for acquiring the signals from the plurality of the electronic photo sensors, and processing the acquired signals into a displayable data;

a plurality of sockets disposed in two rows along the devices holding long side frame member;

a display for displaying the displayable data, the displayable data comprising an elastic panel shape deflection;

the training method comprising steps:

a golfer assumes position on the golfer stand assembly;

the golfer swinging a golf club and hitting the tethered ball resting on the elastic flexible panel, thereby causing:

the elastic panel shape to deform;

the tether assembly arm with the ball disposed on the tether assembly arm to rotate;

the camera to record a golf club swing arc;

the recorded golf club swing arc being displayed on the display;

the plurality of the photosensors signals being processed into displayable data depicting the elastic panel shape deformation; and the displayable data depicting the elastic panel shape deformation being displayed on the display.

* * * * *